US005766816A

United States Patent [19]

Nagase et al.

[11] Patent Number: 5,766,816

[45] Date of Patent: Jun. 16, 1998

[54] IMAGE FORMING METHOD AND IMAGE FORMING APPARATUS

[75] Inventors: Tatsuya Nagase; Yoshiki Nishimori; Meizo Shirose, all of Hachioji, Japan

[73] Assignee: Konica Corporation, Japan

[21] Appl. No.: 758,958

[22] Filed: Dec. 2, 1996

[30] Foreign Application Priority Data

Dec. 5, 1995 [JP] Japan ..... 7-316683

[51] Int. Cl.[6] ..... G03G 13/20; G03G 9/087

[52] U.S. Cl. ..... 430/124; 430/126

[58] Field of Search ..... 430/98, 99, 126, 430/124

[56] References Cited

U.S. PATENT DOCUMENTS 5,266,458 11/1993 Matsubayshi et al. ..... 430/106.6

5,576,821 11/1996 Rasch et al. ..... 355/284

*Primary Examiner*—John Goodrow

*Attorney, Agent, or Firm*—Jordan B. Bierman; Bierman, Muserlian and Lucas

[57] ABSTRACT

An image forming method comprises the step of a) developing an electrostatic latent image with toner; b) transferring the developed image onto a recording material to obtain a toner image on the recording material; and c) passing the recording material with the toner image between a first member and a second member positioned against the first member to fix the toner on the recording material, a silicone oil having been coated on the surface of at least one of the members, the toner containing a blend of a cross-linked polyester resin and a styrene/acryl resin, wherein the MEK insoluble component content of the toner is 40 to 65 weight %, the MEK soluble component of the toner has a weight average molecular weight Mw of $5\times10^4$ to $2\times10^5$, a number average molecular weight Mn of $1\times10^3$ to $2\times10^3$ and Mw/Mn of 25 to 80, and the silicone oil is a fluorine-containing silicone oil having a structure unit represented by the following Formula (I):

Formula (I)

10 Claims, 1 Drawing Sheet

IMAGE FORMING METHOD AND IMAGE FORMING APPARATUS

FIELD OF THE INVENTION

The invention relates to an image forming method and an image forming apparatus for electrophotography employing an electrostatic image developing method which is applied to a copier or a printer.

BACKGROUND OF THE INVENTION

In electrophotography, a heat roller fixing method has been widely used to fix toner onto a recording material (generally, a sheet of recording paper) in view of its heat efficiency or suitability to high speed fixing. This heat roller fixing method is a method which passes a recording material having a toner image thereon between a heat roller with a heat source therein and a pressure applying roller, and thereby fusibly fixes the toner onto the recording material.

In this method, although the method has the above advantages, there is the so-called "offset phenomenon" disadvantage in which toner on a recording material is transferred to the heat roller, and after the rotation of the heat roller the toner is transferred to undesired portions of another recording material and fixed, resulting in stain occurrence on the recording material.

In order to prevent the offset phenomenon in the fixing roller method, a technique supplying a dimethyl silicone oil onto the surface of the heat fixing roller has so far been proposed. This method effectively prevents the offset phenomenon, however, it requires a silicone oil such as dimethyl polysiloxane supplying device and has further a problem of smoke generated by the heated oil. Further, too much oil coating produces undesirable excessive gloss on formed images and this excessive gloss occurs also due to too much fusing of toner during fixing. Accordingly, appropriate gloss is required in practical use.

On the other hand, there are many proposals which give an anti-offset property to the toner itself. For example, a technique using a resin having a broad molecular weight distribution as a binder resin in the toner, as disclosed in Japanese Patent O.P.I. Publication No. 50-234652/1975, and also a technique adding a releasing agent such as a low molecular weight polypropylene, as disclosed in Japanese Patent O.P.I. Publication No. 49-65231/1974.

The above proposed techniques definitely have an excellent effect on the prevention of the offset phenomenon, however, there is the problem in that they have only a narrow fixing temperature range and do not sufficiently show a fixing property, resulting in reduced life time of the fixing roller due to staining. The conventional silicone oil has a positive-charging property as a frictional electrification property, and the fixing roller having the silicone oil on the surface is likely to be positively charged. Therefore, when toner having a negative-charging property is used, the phenomenon is likely to occur in which the recording material is wound around the fixing roller.

The use of a cross-linked polyester resin obtained from an aromatic di- or polycarboxylic acid and an aromatic di- or polyhydric alcohol, which has an aromatic group in its molecule, is well known as a technique improving fixibility. This polyester resin is likely to be negatively charged due to the presence of the aromatic ring. Conventional dimethyl polysiloxane is likely to be positively charged, and electrostatic adhesion of the resin to a fixing member occurs, resulting in occurrence of offset phenomenon.

A silicone oil having a trifluoropropyl group in its side chain is disclosed in Japanese Patent O.P.I. Publication No. 52-124338/1987. This oil has only one carbon atom having a fluorine atom, and cannot greatly improve the fixing property as compared to the conventional silicone oil. Japanese Patent O.P.I. Publication No. 52-124338/1987 also discloses a fixing device comprising an iron fixing roller covered with a tetrafluoroethylene resin. However, this fixing roller is hard and is not deformed by a pressure applying member, and therefore, a nip width is difficult to increase between the fixing roller and the pressure applying roller. When the polyester resin is employed, the fixibility is lowered, and when a high pressure is applied to increase the nip width, the fixing device itself is greatly deformed, resulting in reduced durability of the fixing device.

A conventional fixing device is mainly comprised of an pressure applying roller member having a silicone rubber layer on the surface as described above and a heat fixing member comprising an iron or aluminium cylinder having a fluorine-containing resin layer on the surface. However, this has the problem as described above, and therefor, it has been proposed that each member has a silicone rubber layer on each surface. This fixing device can increase the nip width and lengthen the heating time as compared with the conventional device, resulting in fixing property improvement. This device also has the advantage of minimizing the problem of recording material curling, since the pressure can be uniformly applied without influence of concave and convex of the recording material.

However, this device, in which both rollers are made of a silicone rubber layer, is likely to incur scratches or toner stains on the rollers. The silicone rubber layers are preferably covered by fluorine-containing resin layers, but the fluorine-containing resin has poor wettability to a conventional silicone oil such as dimethyl polysiloxane or a silicone oil having a trifluoromethyl group in its side chain. So, a large amount of the silicone oil needs to be supplied to compensate for the poor wettability, but it produces stains on a charging device, a transfer device or a separation device or on a recording material.

Recently, improvement of scratch resistance of the fixing rollers has been also required to increase fixing durability or to endure a long term use. However, a fixing device which solves the above problems has not yet been obtained.

SUMMARY OF THE INVENTION

A first object of the invention is to provide an image forming method and an image forming apparatus which are free from occurrence of the offset phenomenon, from the winding phenomenon in which a recording material is wound around the fixing roller and from stains on the fixing member such as the fixing roller and to provide appropriate gloss on formed images.

A second object of the invention is to provide an image forming method and an image forming apparatus which improve scratch resistance of the fixing roller and greatly increase the life of the fixing device.

DETAILED DESCRIPTION OF THE INVENTION

Figure 1:
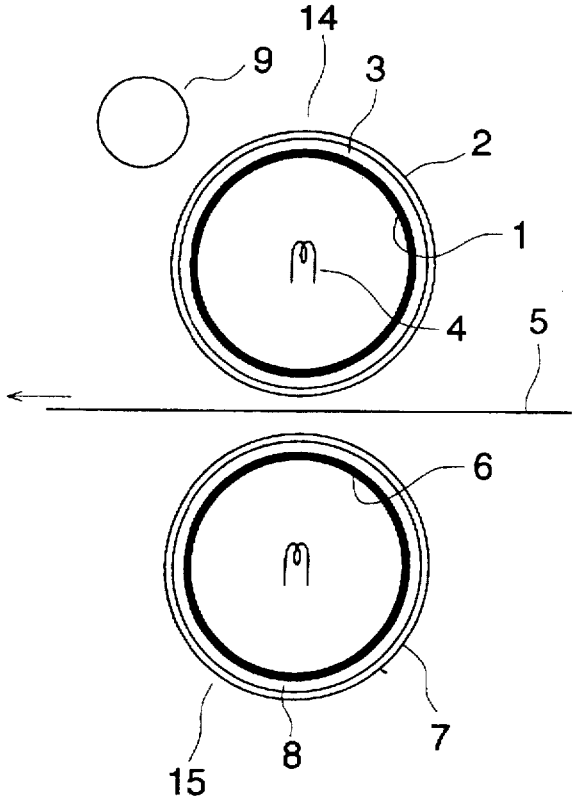
FIG. 1 shows an example of a heat roller fixing device.

The above object of the invention can be attained by the following:

(1) an image forming method comprising the steps of:

a) developing an electrostatic latent image with toner;

b) transferring the developed image onto a recording material to obtain a toner image onto the recording material; and c) passing the recording material with the toner image between a first member and a second member positioned against the first member to fix the toner on the recording material, a silicone oil having been coated on the surface of at least one of the members, the toner containing a blend of a cross-linked polyester resin and a styrene/acryl resin, wherein the MEK insoluble component content of the toner is 40 to 65 weight %, the MEK soluble component of the toner has a weight average molecular weight Mw of $5\times10^4$ to $2\times10^5$, a number average molecular weight Mn of $1\times10^3$ to $2\times10^3$ and Mw/Mn of 25 to 80, and the silicone oil is a fluorine-containing silicone oil having a structure unit represented by the following Formula (I):

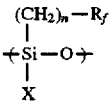

Formula (I)

wherein X represents a saturated hydrocarbon group having 1 to 4 carbon atoms or an aryl group; $R_f$ represents a group represented by $Z-(CF_2)m-$in which Z represents a hydrogen atom or a fluorine atom and m represents an integer of 2 to 10; and n represents an integer of 1 to 4, (2) the method of (1) above, wherein the styrene/acryl resin content is 5 to 25 parts by weight based on 100 parts by weight of the polyester resin, (3) the method of (1) above, wherein the styrene/acryl resin has a weight average molecular weight Mw' of $1\times10^4$ to $4\times10^4$, a number average molecular weight Mn' of $4\times10^3$ to $2\times10^4$ and Mw'/Mn' of not more than 5, (4) the method of claim 1, wherein tangent loss (tan δ) at 200° C. of the toner is within the range of 0.6 to 3.0, (5) the method of (1) above, wherein each of the first and second members is a roller having a silicone rubber layer and a fluorine-containing resin layer in that order provided thereon, or (6) an image forming apparatus comprising a) means of developing an electrostatic latent image with toner;

b) means of transferring the developed image onto a recording material to obtain a toner image onto the recording material; and c) means of passing the recording material with the toner image between a first member and a second member positioned against the first member to fix the toner on the recording material, a silicone oil having been coated on the surface of at least one of the members, the toner containing a blend of a cross-linked polyester resin and a styrene/acryl resin, wherein the MEK insoluble component content of the toner is 40 to 65 weight %, the MEK soluble component of the toner has a weight average molecular weight Mw of $5\times10^4$ to $2\times10^5$, a number average molecular weight Mn of $1\times10^3$ to $2\times10^3$ and Mw/Mn of 25 to 80, and the silicone oil is a fluorine-containing silicone oil having a structure unit represented by the following Formula (I):

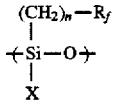

Formula (I)

wherein X represents a saturated hydrocarbon group having 1 to 4 carbon atoms or an aryl group; Rf represents a group represented by $Z-(CF2)_m-$ in which Z represents a hydrogen atom or a fluorine atom and m represents an integer of 2 to 10; and n represents an integer of 1 to 4.

The constitution of the invention will be detailed below.

1. Fluorine-containing silicone oil in the invention The fluorine-containing silicone oil in the invention is a silicone oil having a structure unit represented by the above formula (I).

In formula (I), X represents a saturated hydrocarbon group having 1 to 4 carbon atoms or an aryl group; $R_f$ represents a group represented by $Z-(CF2)_m-$ in which Z represent a hydrogen atom or a fluorine atom and m represents an integer of 2 to 10, and preferably 2 to 8; and n represents an integer of 1 to 4.

It is essential that the fluorine-containing silicone oil in the invention have the above structure unit, but may be a copolymer further comprising a dimethyl silicone, phenylmethyl silicone or diphenyl silicone structure unit.

It is essential that the fluorine-containing silicone oil be a liquid having an appropriate viscosity on its usage. The kinetic viscosity of the fluorine-containing silicone oil has 20 to 1,000 centipoise cs, and preferably 100 to 500 cs in terms of viscosity. This viscosity can be controlled while adjusting the degree of polymerization of the silicone oil. The viscosity is obtained by measuring through a Ubbelohde's viscometer according to ASTM D445-46T or JIS Z8803.

When the fluorine-containing silicone oil in the invention is a copolymer, the silicone oil preferably contains 20 mol % or more of the structure unit represented by Formula (I), in view of the degree of attaining the object of the invention.

The fluorine-containing silicone oil of the invention is synthesized in the same manner as the conventional silicone oil synthetic method. The dialkyl-substituted dichlorosilane is prepared from dichlorosilane and an alkyl chloride, and is hydrolyzed to form a siloxane. Thereafter, the cyclic oligomer or linear oligomer is formed and polymerized to obtain a silicone oil. The fluorine-containing silicone oil of the invention is one having a fluoroalkyl group in the side chain, and synthesized using a fluorine-containing compound having a chloro group at the end instead of an alkylchloride, for example, a compound having a structure represented by the following Formula:

$$Z(CF_2)_m(CH_2)_nCl$$

wherein Z represents a hydrogen atom or a fluorine atom; m represents an integer 2 to 10; and and n represents an integer 1 to 4.

The typical examples of the compound are listed below.

(A) $CF_3CF_2CH_2Cl$ (B) $CF_3CF_2CF_2CH_2Cl$ (C) $CF_3CF_2CF_2(CH_2)_2Cl$ (D) $CF_3CF_2CF_2CF_2(CH_2)_2Cl$ (E) $CF_3CF_2CF_2CF_2CF_2CH_2Cl$ (F) $CF_3CF_2CF_2CF_2CF_2(CH_2)_3Cl$ (G) $CF_3CF_2CF_2CF_2CF_2CF_2CH_2Cl$ (H) $CF_3CF_2CF_2CF_2CF_2CF_2CF_2CH_2Cl$ (I) $HCF_2CF_2CH_2Cl$ (J) $HCF_2CF_2CF_2CH_2Cl$ (K) $HCF_2CF_2CF_2(CH_2)_2Cl$
(L) $HCF_2CF_2CF_2CF_2CH_2Cl$
(M) $HCF_2CF_2CF_2CF_2(CH_2)_2Cl$
(N) $HCF_2CF_2CF_2CF_2(CH_2)_4Cl$
(O) $HCF_2CF_2CF_2CF_2CF_2(CH_2)_3Cl$
(P) $HCF_2CF_2CF_2CF_2CF_2CF_2CH_2Cl$

The alkyl chloride for introducing an alkyl group other than a fluoroalkyl group to the oil includes methyl chloride, ethyl chloride, propyl chloride and butyl chloride.

The typical examples of the fluorine-containing silicone oil are listed below.

(1)

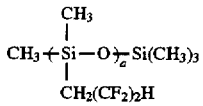

Viscosity: 450 cs (2)

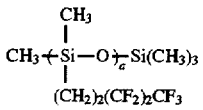

Viscosity: 250 cs (3)

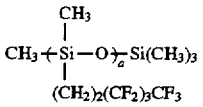

Viscosity: 300 cs (4)

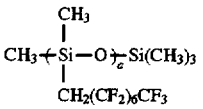

Viscosity: 500 cs (5)

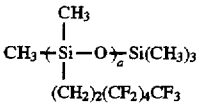

Viscosity: 350 cs (6)

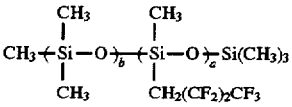

Viscosity: 320 cs
a:b = 80:20

(7)

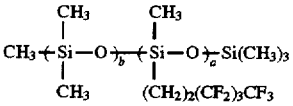

Viscosity: 300 cs
a:b = 60:40

(8)

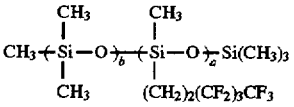

Viscosity: 300 cs
a:b = 70:30

(9)

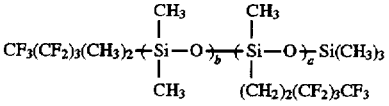

Viscosity: 300 cs
a:b = 80:20

(10)

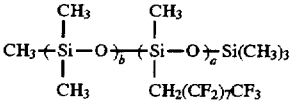

Viscosity: 450 cs
a:b = 50:50

-continued (11)

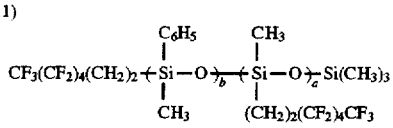

Viscosity: 200 cs
a:b = 30:70

(12)

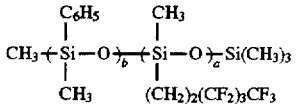

Viscosity: 500 cs
a:b = 90:10

(13)

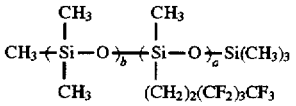

Viscosity: 300 cs
a:b = 80:20

In the above Formulae, a and b independently represent an integer of not less than 1, preferably 10 to 2000, and more preferably 100 to 1000.

2 Developer

The toner used in the invention is prepared by mixing a blend of a cross-linked polyester resin and a styrene/acryl resin, a colorant, a releasing agent and optionally other additives, kneading the mixture to obtain color particles, and adding inorganic fine particles to the color particles. The toner has a volume average particle diameter of ordinarily 1–30 μm, and preferably 5–15 μm. The resin contained in the color particles is preferably a cross-linked polyester resin having an aromatic ring, which is prepared employing an aromatic di-or polycarboxylic acid and an aromatic diol or an aromatic polyhydric alcohol.

The polyester resin is obtained by polycondensation of a polycarboxylic acid having two or more carboxy groups with a polyhydric alcohol having two or more hydroxy groups.

Examples of the Aromatic Polycarboxylic Acid

The aromatic polycarboxylic acid includes phthalic acid, isophthalic acid, telephthalic acid, 1,2,4 benzenetricarboxylic acid, 2,5,7-naphthalenetricarboxylic acid, 1,2,4-naphthalenetricarboxylic acid and pyromellitic acid and an anhydride thereof.

Examples of a dicarboxylic acid other than the above polycarboxylic acid

The dicarboxylic acid other than the above polycarboxylic acid includes maleic acid, fumalic acid, cytrconic acid, itaconic acid, succinic acid, adipic acid, sebatic acid, malonic acid, n-dodecylsuccinic acid, n-dodecenylsuccinic acid, isododecylsuccinic acid, isododecenylsuccinic acid, n- acid, n-octenylsuccinic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid and an empol trimer and an anhydride thereof.

Examples of the aromatic polyhydric alcohol

The aromatic polyhydric alcohol includes an etherified bisphenol A such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene (2.0)-2,2-bis(4-hydroxyphenyl)propane or polyoxypropylene (6)-2,2-bis(4-hydroxyphenyl)propane, bisphenol A, bisphenol Z and 1,3,5-trihydroxymethylbenzene.

Examples of a polyhydric alcohol other than the above polyhydric alcohol

The polyhydric alcohol other than the above polyhydric alcohol includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane dimethanol, dipropylene glycol, polyethylene glycol, polypropylene glycol, polytetramethylene glycol, hydrogenated bisphenol A, sorbitol, 1,2,3,6-hexane tetrol, 1,4-sorbitan, pentaerythritol, dipentaerythritol, tripentaerythritol, 1,2,4 -butane triol, 1,2,5-pentane triol, glycerol, 2-methylpropane triol, 2-methyl-1,2,4 -butane triol, trimethylol ethane and trimethylol propane.

The content ratio of the above described acid to the alcohol is preferably 1:0.95–1.05 (in moles). The content of each of a tri- or higher polyhydric or a tri- or higher polycarboxylic component depends upon the cross-linking degree of the polyester. The optimal cross-linking degree is obtained by adjusting the content of each component.

The cross-linked polyester resin used in the invention preferably comprises an aromatic ring in its main chain, and the aromatic ring content of the resin is preferably 50 to 100% by weight.

The cross-linked polyester content of the toner is 60 to 98 weight %, and preferably 70 to 95 weight %.

The styrene/acryl resin includes a polymer from styrene or styrene derivatives such as styrene, o-methylstyrene, m-methylstyrene, p-methylstyrene, (α-methylstyrene, p-chlorestyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene, methacrylates such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate, acrylates such as methyl acrylate, ethyl acrylate, n-butyl acrylate, isopropyl acrylate, isobutyl acrylate, t-butyl acrylate, n-octyl acrylate, 2-ethylhexyl acrylate, stearyl acrylate, lauryl acrylate, phenyl acrylate, diethylaminoethyl acrylate, and dimethylaminoethyl acrylate, vinyl esters such as vinyl propionate, vinyl acetate and vinyl benzoate, vinyl ethers such as vinyl methyl ether and vinyl ethyl ether, vinyl ketones such as vinyl methyl ketone, vinyl ethyl ketone and vinyl hexyl ketone, N-vinyl compounds such as N-vinyl carbazole, N-vinyl indole and N-vinyl pyrrolidone, vinyl compounds such as vinyl naphthalene and vinyl pyridine, and N-vinyl pyrrolidone, and acrylate or methacrylate derivatives such as acrylonitrile, methacrylonitrile, acrylamide, N-butylacrylamide, N,N-dibutylacrylamide, methacrylamide, N-butylmethacrylamide, and N-octadecylacrylamide.

The styrene/acryl resin has a weight average molecular weight (Mw') of preferably $1\times10^4$ to $4\times10^4$, a number average molecular weight (Mn') of preferably $4\times10^3$ to $2\times10^4$ in terms of polystyrene according to the GPC method, and a ratio of the weight average molecular weight (Mw') to the number average molecular weight (Mn'), Mw'/Mn' of preferably not more than 5.

It is generally difficult to prepare a resin having a Mw/Mn not more than 2, and therefore, Mw/Mn of the resin is not less than 2. The styrene/acryl resin content of the toner is 4 to 21 weight %, and preferably 6 to 17 weight %.

The resin can be synthesized according to an emulsion polymerization, a suspension polymerization or a solution.

The resin can be synthesized according to an emulsion polymerization, a suspension polymerization or a solution polymerization.

The polymerization initiator includes peroxides such as benzoyl peroxide and lauryl peroxide or azo compounds such as azobisisobutyronitrile and azobisisovaleronitrile. The addition amount of the initiator is preferably 0.1 to 2 weight % based on the monomer weight.

The surface tension of a styrene/acryl resin is 20 to 28 mN/m (200° C.), and the surface tension of a polyester resin is 30 to 35 mN/m (200° C.), as described in Polymer Handbook (Third Edition, VI 411–432 (1989), A Wiley-Interscience Publication). The surface tension of the PFA resin used in the fixing roller is about 13 mN/m (200° C.), and a polyester resin is likely to be adhered to a fixing roller and to occur offset phenomenon, since the polyester resin has higher wettability to the fixing roller. The styrene/acryl resin is preferable in view of wettability to the fixing roller, but is likely to produce static offset phenomenon with a fixing roller due to its electrification property, since it is likely to be positively charged. Therefore, the styrene/acryl resin content of the toner is preferably 5 to 25 parts by weight based on 100 parts by weight of the polyester resin.

The toner of the invention includes colorants such as carbon black, magnetic substance, dyes and pigment. The carbon black includes channel black, furnace black, acetylene black, thermal black, and lump black. The magnetic substance includes ferromagnetic metals such as iron, nickel and cobalt, an alloy containing these metals, ferromagnetic metal compounds such as ferrite and magnetite, alloys containing no ferromagnetic metals which show ferromagnetic property by heat treatment such as so-called Heusler's alloys, Mn—Cu—Al and Mn—Cu—Sn and chromium dioxide. The dyes include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, C.I. Solvent Blue 95 and a mixture thereof. The pigment includes C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Orange 31, C.I. Pigment Orange 43, C.I. Pigment Yellow 14, C.I. Pigment Yellow 17, C.I. Pigment Yellow 93, C.I. Pigment Yellow 94, C.I. Pigment Yellow 138, C.I. Pigment Yellow 185, C.I. Pigment Green 7, C.I. Pigment Blue 15:3, C.I. Pigment Blue 60 and a mixture thereof. The number average first order particle diameter of the colorants is ordinarily 10 to 200 nm, although different depending on the kinds of the colorants.

The colorant content of the toner is 2 to 15 weight %, and preferably 3 to 8 weight %.

As a method to obtain an intended molecular weight of the resin of toner, there is a method of changing kneading conditions in the manufacturing process of the toner including the resin or a method of changing the molecular weight of the resin itself. The changing kneading conditions herein referred to means that of barrel temperature in the kneading process of a typical toner manufacturing process comprising preliminary kneading, kneading, pulverizing, classifying and additive adding additive. When the barrel temperature is high, a shearing force applied to the resin in a kneader is small and the molecular weight of the resin can keep high. In contrast, when the barrel temperature is low, a shearing force applied to the resin in a kneader is large and the molecular weight of the resin can be decreased. Herein, the barrel temperature Tb (° C) and the softening point Ts (° C) of the polyester resin in the toner have the following relation:

$Ts-20 \leqq Tb \leqq Ts+30$(° C.)

The softening point herein referred to means a temperature giving a plunger descending distance of 0.5 mm when the plunger descending distance of a sample is measured at a plunger load of 20 kgf/cm$^2$ while heating at a temperature elevating rate of 6° C. per minute through a die having a 1.0 mm long nozzle of a diameter of 1.0 mm and a flow tester CFT-500 produced by Shimazu Seisakusho Co., Ltd.

The MEK insoluble component content of the toner obtained above is computed according to the following:

In a 40 ml of MEK (methylethyl ketone) are added 0.5 g of toner and dispersed for 15 minutes through a ultrasonic disperser to dissolve the toner in the solvent. The resulting solution is allowed to stand for 20 minutes, centrifuged at 20,000 rpm for 20 minutes and divided into a MEK soluble component A and a MEK insoluble residue B. The MEK insoluble component content of the toner is obtained by the following equation:

MEK insoluble component content (weight %)=Weight of residue $B$(g)×100/total weight of component $A$ and residue $B$(0.5 g)

The MEK insoluble component content of the toner is 40 to 65 wt %. When the MEK insoluble component content is less than 40 wt %, glossiness of an image increases, and the image is difficult to see. In contrast, when the MEK insoluble component content exceeds 60 wt %, high energy is required in fixing and fixing faults is likely to occur.

The molecular weight of the MEK soluble component of the toner is represented in terms of polystyrene according to a GPC method, and the MEK soluble component has a weight average molecular weight (Mw) of $5\times10^4$ to $2\times10^5$, a number average molecular weight (Mn) of $1\times10^3$ to $2\times10^3$and a ratio, Mw/ Mn of 25 to 80.

Herein, the molecular weight of the MEK soluble component is measured according to a GPC method under the following conditions:

A THF (tetrahydrofurane) solution containing 0.5 to 0.6 weight % of the MEK soluble component is prepared. The column in a heat chamber is stabilized at 40° C. employing HLC-8020 produced by Toso Co., Ltd, and a 100 μl of the above THF solution is incorporated into the column in which THF flows in a rate of 1 ml per minute. The molecular weight is obtained from a calibration curve prepared from several monodisperse standard polystyrenes in which logarithm of the molecular weight is linear against an elution count number. At least ten standard polystyrenes (for example, produced by Toso Co., Ltd.) having molecular weights of $2.7\times10^2$ to $6.2\times10^6$ are used to obtain the calibration curve. An RI (refrax index) detector is used as a detector. In order to accurately measure a molecular weight range of $1\times10^2$ to $7\times10^6$, a combination of, for example, TSK gel, G1000H, G2000H, G2500H, G3000H, G4000H, G5000H, G6000H, G7000H or GMH, (each produced by Toso Co., Ltd.) is preferably used as the column.

The releasing agent used in the toner includes a polyolefin wax such as a low molecular weight polyethylene, polypropylene of ethylene-propylene copolymer each having a number average molecular weight (represented in terms of polystyrene according to a high temperature GPC method) of 1500 to 5000 (represented in terms of polystyrene according to a high temperature GPC method), a high melting point paraffin wax such as micro wax or Fischer-Tropsch Wax, an ester wax such as an ester of fatty acid with a lower alcohol, an ester of fatty acid with a higher alcohol, an ester of fatty acid with a polyhydric alcohol and an amide wax. The above wax can be singly or in combination.

The releasing agent content of the toner is 1 to 10 weight %, and preferably 2 to 8 weight %.

The other additives include, for example, a charge controlling agent such as a salicylic acid derivative or an azo metal complex. The inorganic fine particles include silica, titanium oxide, aluminium oxide and barium titanate, strontium titanate, each of which has a number average primary particle diameter of 5 to 1000 nm and may be made hydrophobic.

As a cleaning auxiliary agent, styrene-acryl resin fine particles having a number average primary particle diameter of 0.1 to 2.0 μm or a metal salt of a higher fatty acid such as zinc stearate may be used in toner.

The content of the inorganic fine particles may be 0.1 to 2.0% by weight based on the color particle toner. The cleaning auxiliary agent may be 0.01 to 1.0% by weight based on the color particle toner.

The carrier constituting a two-component developer may be any of a non-covered carrier consisting only of magnetic particles such iron or ferrite, a resin-covered carrier in which the surface of magnetic particles is covered with a resin and a resin-dispersed carrier in which a resin and magnetic powder are mixed. The carrier has a volume average particle diameter of preferably 30 to 150 μm.

The developer comprised of a one-component preferably contains a ferromagnetic material such as magnetite which has a number average particle diameter of 0.1 to 2.0 μm, as a coloring agent. In this case the content of the ferromagnetic material is ordinarily 20 to 60% by weight based on the toner.

Further, in the invention, non-magnetic mono-component toner which consists only of non-magnetic toner without carrier may also be used.

Loss tangent (tan δ) of toner in its fix-fusing state is required to be within the range of 0.6 to 3.0 in determining glossiness of an image formed after fixing. Gloss degree, in which an image on a recording material is pleasant to see, is within the range of 7 to 15. A gloss degree exceeding 15 gives glaringness. A gloss degree of less than 7 is difficult to obtain, and a gloss degree forced to be not more than 5 results in lowering of other toner properties. When tan δ is less than 0.6 in the toner used in the invention containing a blend of the cross-linked polyester resin and the styrene-acryl resin as a binder resin, the elastic component content of the toner is high, requiring a high fixing energy. This causes elevated fixing temperature and under-offset, resulting in heat-caused deterioration and staining of the fixing roller. When tan δ exceeds 3.0 in the toner, the viscous component content of the toner is high, it increases glossiness of a toner image formed and gives glaringness, resulting in deterioration of image quality. Further, such a toner causes hot offset and contaminates the fixing roller. Herein, loss tangent (tan δ) of toner is obtained by measuring using a viscoelastometer MR-500 produced by Rheology Co., Ltd. as follows:

Modulus of viscoelasticity of toner is measured against temperature at a 1 Hz frequency and a strain angle automatically controlled while elevating the temperature, using parallel plates having a diameter of 10 mm, and the loss tangent is represented by a value obtained at 200° C.

Fixing Method

The image forming method and apparatus in the invention include charging, imagewise exposing, development, image transfer and fixing, but they are not specifically limited and the conventional methods and apparatus can be used.

The fixing device preferably used in the invention will be explained below.

As illustrated in FIG. 1, the heat roller fixing device is composed of an upper roller 14 comprised of a metal cylinder 1 with an interior heat source 4 made of a metal such as iron or aluminium and provided thereon, a silicone rubber layer 3 and a fluorine-containing resin layer 2 such as polytetrafluoroethylene or tetrafluoroethylene-perfluoroalkylvinylether copolymer in that order, a lower heat roller 15 comprised of a metal cylinder 6 made of a metal such as iron or aluminium and provided thereon, a silicone rubber layer 8 and a fluorine-containing resin layer 7 such as polytetrafluoroethylene or tetrafluoroethylene-perfluoroalkylvinylether copolymer in that order and a cleaning roller 9. Symbol 5 shows a recording material. The heat source 4 has a linear heater, which heats the surface of the upper roller from about 120° to 200° C.

Figure 2:
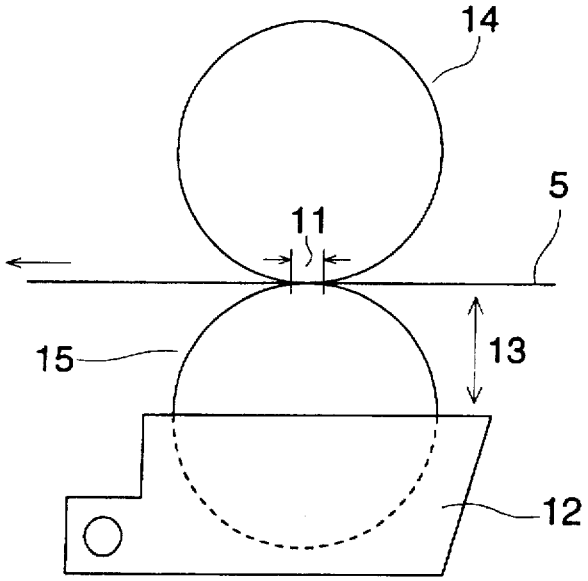
FIG. 2 shows a fixing mechanism.

The heat roller fixing device of FIG. 1 is illustrated to have some space among the upper roller, the lower roller and a cleaning roller, but pressure is applied on fixing, deforming the lower roller and forming a nip between the upper and lower rollers. FIG. 2 shows a fixing mechanism including applying and releasing pressure in which symbol 11 shows a nip width, symbol 12 shows a pressure arm and symbol 13 shows a direction of pressure applying and releasing. The nip width is preferably 1 to 7 mm, and more preferably 2 to 5 mm. When the nip width is too small, it is difficult to apply a uniform heat to toner, resulting in fixing unevenness. When, on the other hand, the nip width is too large, toner fusing is promoted, and the offset phenomenon occurs too much. The fixing line speed is preferably 10 to 400 mm/second.

A cleaning device such as cleaning roller 9 is provided in the fixing device. The cleaning method includes a method of cleaning the upper or lower roller by supplying the fluorine-containing silicone oil used in the invention thereto or a method of cleaning the upper or lower roller with a pad, roller or web impregnated with the fluorine-containing silicone oil used in the invention.

EXAMPLES

The examples of the invention will be detailed below, but are not limited thereto. The "parts" in the following examples represents "parts by weight".

Synthetic Example Of Polyester Resins

The dicarboxylic acid or polycarboxylic acid and diol or polyhydric alcohol shown in Table 1 were placed in an addition ratio as shown in Table 1 in a reaction vessel equipped with a thermometer, a stirrer, a nitrogen incorporporating tube and a condenser. The resulting mixuture was heated under a nitrogen atmosphere, mixed with a small amount of dibutyl tin oxide, and reacted at 200° C. In the above reaction, only difunctional components were reacted in the initial reaction stage, and tri-or more (poly-) functional components were added at the time when the dibutyl tin oxide was added. In Table 1, the addition amount of each component is represented by weight ratio.

TABLE 1

| | Aromatic Polycarboxylic Acid | | Aliphatic carboxylic Acid | | Aromatic Dihydric Alcohol | Aliphatic Polyhydric Alcohol | | |
|---|---|---|---|---|---|---|---|---|
| | Trifunctional | Bifunctional | Bifunctional | | Bifunctional | Bifunctional | | Trifunctional |
| Resin No. | TMA | TPA | FA | DKA | BPA-PO | EG | NPG | TMP |
| Resin P-1 | 30 | 55 | 0 | 15 | 100 | 0 | 0 | 0 |
| Resin P-2 | 55 | 45 | 0 | 0 | 100 | 0 | 0 | 0 |
| Resin P-3 | 50 | 20 | 10 | 0 | 40 | 25 | 35 | 0 |
| Resin P-4 | 0 | 90 | 10 | 0 | 25 | 0 | 40 | 35 |
| Comparative Resin P-5 | 0 | 50 | 50 | 0 | 100 | 0 | 0 | 0 |
| Comparative Resin P-6 | 0 | 100 | 0 | 0 | 100 | 0 | 0 | 0 |
| Comparative Resin P-7 | 70 | 20 | 10 | 0 | 45 | 25 | 30 | 0 |

*TMA: 1,2,4-Benzenetricarboxylic acid
*TPA: Telephthalic acid
*FA: Fumalic acid
*DKA: n-Dodecenylsuccinic acid
*BPA-PO: Polyoxypropylene (2,2)-2,2-bis(4-hydroxyphenyl)propane
*EG: Ethylene glycol
*NPG: Neopentyl glycol
*TMP: Trimethylol propane The added amount ratio (by weight) of the aromatic compounds and softening points (Ts) in the above described resins are shown in Table 2.

TABLE 2

| Resin No. | Aromatic compound added amount ratio | Softening point (Ts) |
|---|---|---|
| Resin P-1 | 92.5% | 122° C. |
| Resin P-2 | 100.0% | 135° C. |
| Resin P-3 | 55.0% | 129° C. |
| Resin P-4 | 57.5% | 120° C. |
| Comparative resin P-5 | 75.0% | 90° C. |
| Comparative resin P-6 | 100.0% | 97° C. |
| Comparative resin P-7 | 67.5% | 153° C. |

Synthetic Example of Styrene/Acryl Resins

| Synthesis of Resin S-1 | |
|---|---|
| Styrene | 65 parts |
| Methyl methacrylate | 20 parts |
| n-Butyl acrylate | 15 parts |
| AIBN | 0.2 parts |

Styrene/acryl resin S-1 was prepared from the above monomers in the above amount. Mw, Mn and Mw/Mn of the resin were 15,200, 6,800 and 2.2, respectively.

| Synthesis of Resin S-2 | |
|---|---|
| Styrene | 70 parts |
| Methyl methacrylate | 5 parts |
| n-Butyl methacrylate | 25 parts |

Styrene/acryl resin S-2 was prepared from the above monomers in the above amount. Mw, Mn and Mw/Mn of the resin were 33,300, 14,600 and 2.3, respectively.

| Synthesis of Resin S-3 | |
|---|---|
| Styrene | 80 parts |
| n-Butyl acrylate | 20 parts |
| AIBN | 0.2 parts |

Styrene/acryl resin S-3 was prepared from the above monomers in the above amount. Mw, Mn and Mw/Mn of the resin were 8,000, 3,200 and 2.5, respectively.

| Synthesis of Resin S-4 | |
|---|---|
| Styrene | 65 parts |
| n-Butyl methacrylate | 35 parts |
| AIBN | 0.2 parts |

Styrene/acryl resin S-4 was prepared from the above monomers in the above amount. Mw, Mn and Mw/Mn of the resin were 125,000, 17,000 and 7.4, respectively.

The above obtained polyester resin and styrene/acryl resin, a colorant and a releasing agent (PP, polypropylene) as shown in Table 3 were mixed in an addition amount shown in the following Table 3. The resulting mixture was fusibly kneaded, pulverized and classified to obtain color particles having a volume average particle diameter of 8.5 μm. Thereafter, hydrophobic silica (having a number average particle diameter of 12 nm) was added thereto in an amount of 0.7 weight % to obtain toner. The thus obtained toner will be shown in Table 3.

The barrel temperature in the toner manufacturing, the MEK insoluble component content of the toner, the weight average molecular weight Mw, the number average molecular weight Mn and Mw/Mn of the toner, and tan δ of the toner are shown in Table 4.

TABLE 3

| Addition No. | Polyester (parts) | Styrene/ acryl resin (parts) | Colorant (parts) | Releasing agent (parts) |
|---|---|---|---|---|
| Add-1 | P-1:100 | S-1:12 | C.I. Pigment blue-15 : | PP:3 |
| Add-2 | P-1:100 | S-1:12 | Carbon Black | PP:3 |
| Add-3 | P-1:100 | S-1:8 | C.I. Pigment Blue-15:3 | PP:3 |
| Add-4 | P-2:100 | S-1:23 | C.I. Pigment Yellow-185 | PP:3 |
| Add-5 | P-2:100 | S-1:6 | C.I. Pigment Red-122 | PP:3 |
| Add-6 | P-2:100 | S-1:19 | Carbon Black | PP:3 |
| Add-7 | P-3:100 | S-1:11 | C.I. Pigment Blue-15 :3 | PP:3 |
| Add-8 | P-4:100 | S-1:15 | C.I. Pigment Yellow-17 | PP:3 |
| Add-9 | P-5:100 | None | C.I. Pigment Blue-60 | PP:3 |
| Add-10 | P-6:100 | None | C.I. Pigment Red-122 | PP:3 |
| Add-11 | P-7:100 | S-1:10 | C.I. Pigment Red-48:1 | PP:3 |
| Add-12 | P-2:100 | S-1:32 | C.I. Pigment Yellow-17 | PP:3 |
| Add-13 | P-2:100 | S-1:8 | C.I. Pigment blue-15:3 | PP:3 |
| Add-14 | P-1:100 | S-1:2 | Carbon Black | PP:3 |
| Add-15 | P-1:100 | S-1:14 | C.I. Pigment Yellow-14 | PP:3 |

PP: polypropylene (a number average molecular weight: 2,500)

TABLE 4

| Toner No. | Addition No. | Resin Ts (°C.) | Kneading Tb (°C.) | MEK insoluble component content (wt %) | Molecular weight (GPC) of MEK soluble component Mw (×10⁴) | Mn (×10³) | Mw/Mn | Toner tan δ |
|---|---|---|---|---|---|---|---|---|
| Toner 1 | 1 | 122 | 130 | 40 | 7.08 | 1.31 | 54.0 | 2.8 |
| Toner 2 | 2 | 122 | 110 | 40 | 6.32 | 1.19 | 53.2 | 2.6 |
| Toner 3 | 3 | 122 | 110 | 43 | 6.38 | 1.27 | 50.2 | 2.6 |
| Toner 4 | 4 | 135 | 140 | 55 | 9.73 | 1.70 | 57.3 | 1.7 |
| Toner 5 | 5 | 135 | 165 | 59 | 10.3 | 1.49 | 69.7 | 1.2 |
| Toner 6 | 6 | 135 | 120 | 62 | 7.42 | 1.39 | 53.4 | 0.8 |
| Toner 7 | 7 | 129 | 120 | 50 | 6.61 | 1.25 | 52.8 | 1.1 |
| Toner 8 | 8 | 120 | 115 | 41 | 8.47 | 1.56 | 54.3 | 0.7 |
| Toner 9 | 1 | 122 | 170 | 45 | 4.05 | 1.83 | 22.1 | 2.4 |
| Toner 10 | 3 | 122 | 90 | 23 | 12.70 | 2.01 | 6.3 | 4.6 |
| Toner 11 | 3 | 122 | 180 | 57 | 3.28 | 1.35 | 24.3 | 0.4 |

TABLE 4-continued

| Toner No. | Addition No. | Resin Ts (°C.) | Kneading Tb (°C.) | MEK insoluble component content (wt %) | Molecular weight (GPC) of MEK soluble component Mw ($\times 10^4$) | Mn ($\times 10^3$) | Mw/Mn | Toner tan δ |
|---|---|---|---|---|---|---|---|---|
| Toner 12 | 9 | 90 | 90 | 0 | 11.4 | 4.35 | 2.6 | 9.8 |
| Toner 13 | 10 | 93 | 90 | 0 | 0.47 | 2.56 | 1.8 | 12.5 |
| Toner 14 | 11 | 153 | 135 | 72 | 4.22 | 1.33 | 31.7 | 0.2 |
| Toner 15 | 12 | 135 | 120 | 50 | 5.98 | 1.20 | 49.8 | 1.8 |
| Toner 16 | 13 | 135 | 120 | 50 | 12.1 | 1.67 | 72.5 | 1.2 |
| Toner 17 | 14 | 122 | 115 | 42 | 8.21 | 1.63 | 50.4 | 2.4 |
| Toner 18 | 15 | 122 | 115 | 43 | 6.74 | 1.32 | 51.1 | 2.7 |

Toners 9 through 14 are comparative toners.

Each of these toners was mixed with a ferrite carrier (having a volume average particle diameter of 62 δm) covered with a styrene/acryl resin to obtain developer having a toner content of 7 weight %.

★ For a copier for evaluation, Konica U-BIX1520 produced by Konica Corporation was modified and used. The fixing device was modified to obtain the following fixing conditions:

The heat roller fixing device was composed of an upper roller comprised of an aluminium cylinder of a 30 mm diameter with a heat source 4 inside and provided thereon, a 0.8 mm thick silicone rubber (JIS-A hardness 30°) layer and a tetrafluoroethylene-perfluoroalkylvinylether copolymer layer in that order and a lower heat roller comprised of an aluminium cylinder of a 25 mm diameter and provided thereon, a 1.0 mm thick silicone rubber (JIS-A hardness 40°) layer and a tetrafluoroethylene-perfluoroalkylvinylether copolymer layer in that order. The surface temperature of the fixing upper roller varies from 110° to 230° C. The printing line speed of the fixing device is 100 mm/second. This fixing device was equipped with a cleaning device which was a pad roller impregnated with the fluorine-containing silicone oil. As the fluorine-containing silicone oil, Exemplified compound (3), (7), (8) and (13) were used, and the fixing rollers employing them were designated to be R-1, R-2, R-3 and R-4, respectively.

For comparison, a silicone oil composed of dimethyl polysiloxane (dimethyl silicone oil) or a fluorinated silicone oil (FS-1265 produced by Dow Corning Co., Ltd.) having a simple trifluoromethyl group as a side chain fluorinated alkyl as described in Japanese Patent O.P.I. Publication No. 52124338/1977 was used in the above described cleaning device, pad roller. The heat roller fixing device using the dimethyl silicone oil was designated to be RC-1, and the heat roller fixing device using the fluorinated silicone oil having a trifluoromethyl group to be RC-2.

(Evaluation)

Evaluation of Fixing Rate

The fixing rate was measured as follows:

The solid image was developed using the above obtained developers, and then transferred to paper, XEROX4024. The transferred image was fixed at 10° C. and 20%RH using the above fixing device, the fixing temperature being raised from 110° C. to 230° C. in 5° C. increments. After the resulting paper was folded at the transferred image portions, the image was rubbed ten times with a cloth using a friction fastness tester for a JIS L0823 dye fastness test and the image reflection densities before and after the rubbing were measured with RD-918. The fixing rate was measured from the density difference according to the following equation. The initial image density was adjusted to 1.40 relative to 0 of the background density of the paper, and the measurement was carried out.

Fixing rate=Density after rubbing/Density before rubbing (1.40)×100(%) When the fixing rate is 80% or more, there is no problem for practical use. The fixibility was evaluated by the temperature at which a fixing rate of 80% was obtained. The fixing device in which the temperature giving a fixing rate of 80% exceeds 150° C. is undesirable.

Evaluation of Gloss Degree

The gloss degree was measured as follows:

A solid image was developed using the above obtained developers, transferred to Xerox 4024, 20Lb paper and fixed at 190° C. The resulting image was measured by a gloss meter at an incident angle of 75°. A gloss degree exceeding 15 gives a glaring image, so that a gloss degree not more than 15 is preferable for practical use.

Evaluation of Stains on the Fixing Roller

The fixing device was set to a fixing temperature of 180° C. and a silicone oil coating amount of 0.5 mg per A4 size. Two thousand sheets of paper having an image area rate of 9% were passed through the fixing device, and stains on the fixing roller were evaluated according to the following criteria:

○: No stains on the fixing roller

Δ: Some stains on the fixing roller

×: Stains on the entire fixing roller

The results are shown in Table 5.

TABLE 5

| Toner | Temperature giving a fixing rate of 80%/stains on the fixing roller | | | | | | Gloss |
|---|---|---|---|---|---|---|---|
| No. | R-1 | R-2 | R-3 | R-4 | R-C1 | R-C2 | degree |
| Toner 1 | 145/A | 145/A | 145/A | 145/A | 155/C | 155/B | 14 |
| Toner 2 | 145/A | 145/A | 145/A | 145/A | 155/C | 155/B | 11 |
| Toner 3 | 145/A | 145/A | 145/A | 145/A | 155/C | 155/B | 11 |
| Toner 4 | 140/A | 140/A | 140/A | 140/A | 160/C | 155/B | 7 |
| Toner 5 | 140/A | 140/A | 140/A | 140/A | 160/C | 160/B | 5 |
| Toner 6 | 145/A | 145/A | 145/A | 145/A | 165/C | 160/B | 9 |
| Toner 7 | 140/A | 140/A | 140/A | 140/A | 160/C | 155/B | 14 |
| Toner 8 | 140/A | 140/A | 140/A | 140/A | 155/C | 155/B | 10 |
| Toner 9 | 155/B | 155/B | 155/B | 155/B | 170/C | 165/C | 10 |
| Toner 10 | 140/C | 140/C | 140/C | 140/C | 160/C | 155/C | 18 |
| Toner 11 | 165/B | 165/B | 165/B | 165/B | 175/C | 170/C | 5 |
| Toner 12 | 130/C | 130/C | 130/C | 130/C | 140/C | 140/C | 21 |
| Toner 13 | 130/C | 130/C | 130/C | 130/C | 140/C | 140/C | 48 |
| Toner 14 | 170/B | 170/B | 170/B | 170/B | 185/C | 180/C | 4 |
| Toner 15 | 140/B | 140/B | 140/B | 140/B | 160/C | 160/C | 7 |
| Toner 16 | 140/B | 140/B | 140/B | 140/B | 160/C | 160/C | 6 |
| Toner 17 | 140/B | 140/B | 140/B | 140/B | 160/C | 160/C | 11 |
| Toner 18 | 145/B | 145/B | 145/B | 140/B | 175/C | 175/C | 13 |

Toners 9 through 14 are comparative toners.

As is apparent from Table 5, the inventive toner posseses excellent fixibility and glossiness without producing stains on the fixing roller. On the other hand, the comparative toner, being outside the scope of the invention, is problematic in fixibility, glossiness and/or stains on the fixing roller and does not show properties sufficient to be put into practical use.

What is claimed is:

1. An image forming method comprising the steps of:

a) developing an electrostatic latent image with toner;

b) transferring the developed image onto a recording material to obtain a toner image on the recording material; and c) passing the recording material with the toner image between a first member and a second member positioned against the first member to fix the toner on the recording material, a silicone oil having been coated on the surface of at least one of the members, the toner containing a blend of a cross-linked polyester resin and a styrene/acryl resin, wherein the MEK insoluble component content of the toner is 40 to 65 weight %, the MEK soluble component of the toner has a weight average molecular weight Mw of $5\times10^4$ to $2\times10^5$, a number average molecular weight Mn of $1\times10^3$ to $2\times10^3$ and Mw/Mn of 25 to 80, and the silicone oil is a fluorine-containing silicone oil having a structure unit represented by the following Formula (I):

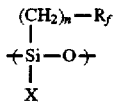

Formula (I)

wherein X represents a saturated hydrocarbon group having 1 to 4 carbon atoms or an aryl group; $R_f$ represents a group represented by $Z-(CF2)_m-$ in which Z represents a hydrogen atom or a fluorine atom and m represents an integer of 2 to 10; and n represents an integer of 1 to 4.

2. The method of claim 1, wherein said m represents an integer of 2 to 8.

3. The method of claim 1, wherein said fluorine-containing silicone oil contains 20 mol % or more of the structure unit represented by said Formula (I).

4. The method of claim 1, wherein tangent loss (tan δ) at 200° C. of the toner is within the range of 0.6 to 3.0.

5. The method of claim 1, wherein the styrene/acryl resin content is 5 to 25 parts by weight based on 100 parts by weight of the polyester resin.

6. The method of claim 1, wherein the styrene/acryl resin has a weight average molecular weight Mw' of $1\times10^4$ to $4\times10^4$, a number average molecular weight Mn' of $4\times10^3$ to $2\times10^4$ and Mw'/Mn' of not more than 5.

7. The method of claim 1, wherein the cross-linked polyester resin comprises an aromatic ring in its main chain.

8. The method of claim 7, wherein the aromatic ring content of the cross-linked polyester resin is 50 to 100% by weight.

9. The method of claim 1, wherein each of the first and second members is a roller having a silicone rubber layer and a fluorine-containing resin layer in that order provided thereon.

10. The method of claim 1 wherein said first member is a first fixing roller and said second member is a second fixing roller.

* * * * *